US006511351B2

(12) United States Patent
Sato

(10) Patent No.: US 6,511,351 B2
(45) Date of Patent: Jan. 28, 2003

(54) CONNECTOR SYSTEM

(75) Inventor: Kei Sato, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/910,078

(22) Filed: Jul. 23, 2001

(65) Prior Publication Data

US 2002/0137401 A1 Sep. 26, 2002

(30) Foreign Application Priority Data

Jul. 24, 2000 (JP) ..... 2000-222978

(51) Int. Cl.[7] ..... H01R 9/22
(52) U.S. Cl. ..... 439/709
(58) Field of Search ..... 439/709, 710, 439/744, 701, 703, 200, 877

(56) References Cited

U.S. PATENT DOCUMENTS 5,716,232 A * 2/1998 Endo et al. ..... 439/595
6,203,334 B1 * 3/2001 Daoud et al. ..... 379/399.01
6,296,531 B1 * 10/2001 Nagamine ..... 439/595
6,386,925 B1 * 5/2002 Sato et al. ..... 439/701

FOREIGN PATENT DOCUMENTS

JP 1-103168 7/1989

* cited by examiner

*Primary Examiner*—Lynn D. Feild
*Assistant Examiner*—Phuong Dinh
(74) *Attorney, Agent, or Firm*—Finnegan, Henderson, Farabow, Garrett & Dunner, L.L.P.

(57) ABSTRACT

A first connector includes a set of stacked first housings (29). First housings (29) each include side walls (43) defining channels (41) therebetween. The first connector includes a set of terminal units (36). Terminal units (36) each include a set of first terminals (37). Respective first terminals (37) are located in respective channels (41). One of first terminals (37) is configured to pass through a neighboring first housing (29) with a neighboring first terminal (37) and to connect the neighboring first terminal (37). A second connector (31) is mated with the first connector. The second connector (31) includes a second housing (93) holding the set of first housings (29). The second connector (31) includes a second terminal (44) housed in the second housing (93). The second terminal (44) is configured to pass though the second housing (93) and one of the first housings (29) and to connect one of first terminals (37).

9 Claims, 4 Drawing Sheets

CONNECTOR SYSTEM

BACKGROUND OF THE INVENTION

1. Field of the Invention

The invention relates to a connector system which includes multiple-stepped stacked housings and a holder mated with each other to constitute a three dimensional circuit 2. Description of Relevant Art A conventional connector system, as shown in Utility Model Application Laid-open Publication of NO. H1-103168, includes internal connectors and external connectors mated with each other.

The internal connectors each include a housing; a terminal housed in the housing; wires connected to the terminal for the contact with each other. The terminal has branches in accordance with the design of the electrical circuit, with a wire being connected thereto by crimping. A connector at the termination of another wire connects another wire to one of branches.

An external connector includes conductors; a lower case housing the conductors; an upper case closing the lower case, with connector mounting parts for assembling with the housings being provided on an upper face.

In such formed connector system, housings are mated with the connector mounting parts, respectively, for the contact with the wires and conductors of the external connectors via the terminal of each housing, to constitute a circuit.

SUMMARY OF THE INVENTION

The conventional connector system, however, has the large number of the internal connectors when constituting the complicated circuit, and increases the number of wires connected to the branches, thus causing the possibility in over-enlargement and low workability of the manufacturing of the circuit due to the increment of the operation steps of the assembly.

In the connector system, in accordance with the design of the electrical circuit, the number of wires and the number of branches connected to the wires can be changed. This needs a plurality of kinds of the terminal with the different number of branches and the housings housing the terminals, thus causing high production costs. It therefore is an object of the present invention to provide a connector system which facilitates to constitute a complicated circuit without over-enlargement, and reduces production costs.

To achieve the object, a first aspect of the invention provides the following connector system. A first connector includes a set of stacked first housings. First housings each include side walls defining channels therebetween. The first connector includes a set of terminal units. Terminal units each include a set of first terminals. Respective first terminals are located in respective channels. One of first terminals is configured to pass through a neighboring first housing with a neighboring first terminal and to connect the neighboring first terminal. A second connector is mated with the first connector. The second connector includes a second housing holding the set of first housings. The second connector includes a second terminal housed in the second housing. The second terminal is configured to pass through the second housing and one of the first housings and to connect one of first terminals.

Preferably, first terminals each include a base sheet; and a contact sheet extending from the base sheet and having an end. The contact sheet is turned back and facing the base sheet. The contact sheet includes a first contact part raised at the end for contacting a neighboring first terminal in a neighboring first housing.

Preferably, the contact sheet includes a second contact part defining a contact hole for inserting the second terminal and contacting the second contact part with the second terminal.

Preferably, the contact hole is inclined to an insertion direction of the second terminal.

Preferably, the second contact part includes a projection projecting inside of the contact hole. The projection is configured to press the second terminal for contact, with the second terminal being inserted into the contact hole.

Preferably, the contact sheet includes a connection part configured to connect a neighboring first contact part in a neighboring first housing. The connection part includes: a press part raised from the contact sheet and defining an opening for inserting the neighboring first contact part. The press part is configured to press a side of the neighboring first contact part. The connection part includes a support part facing the press part for supporting another side of the neighboring first contact part.

Preferably, the connection part includes a protrusion on one of the press part and the support part.

Preferably, the terminal units each include a connection sheet crossing over a side wall and connecting between neighboring first terminals.

Preferably, first terminals each include a blade for displacing an insulation of an insulated wire to be contacted.

BRIEF DESCRIPTION OF THE ACCOMPANYING DRAWINGS

These and other features, aspects, and advantage of the present invention will become better under stood with regard to the following description, appended claims, and accompanying drawings where:

DETAILED DESCRIPTION OF THE PREFERRED EMBODIMENTS

An embodiment of the invention will be explained with reference to drawings.

Figure 1:
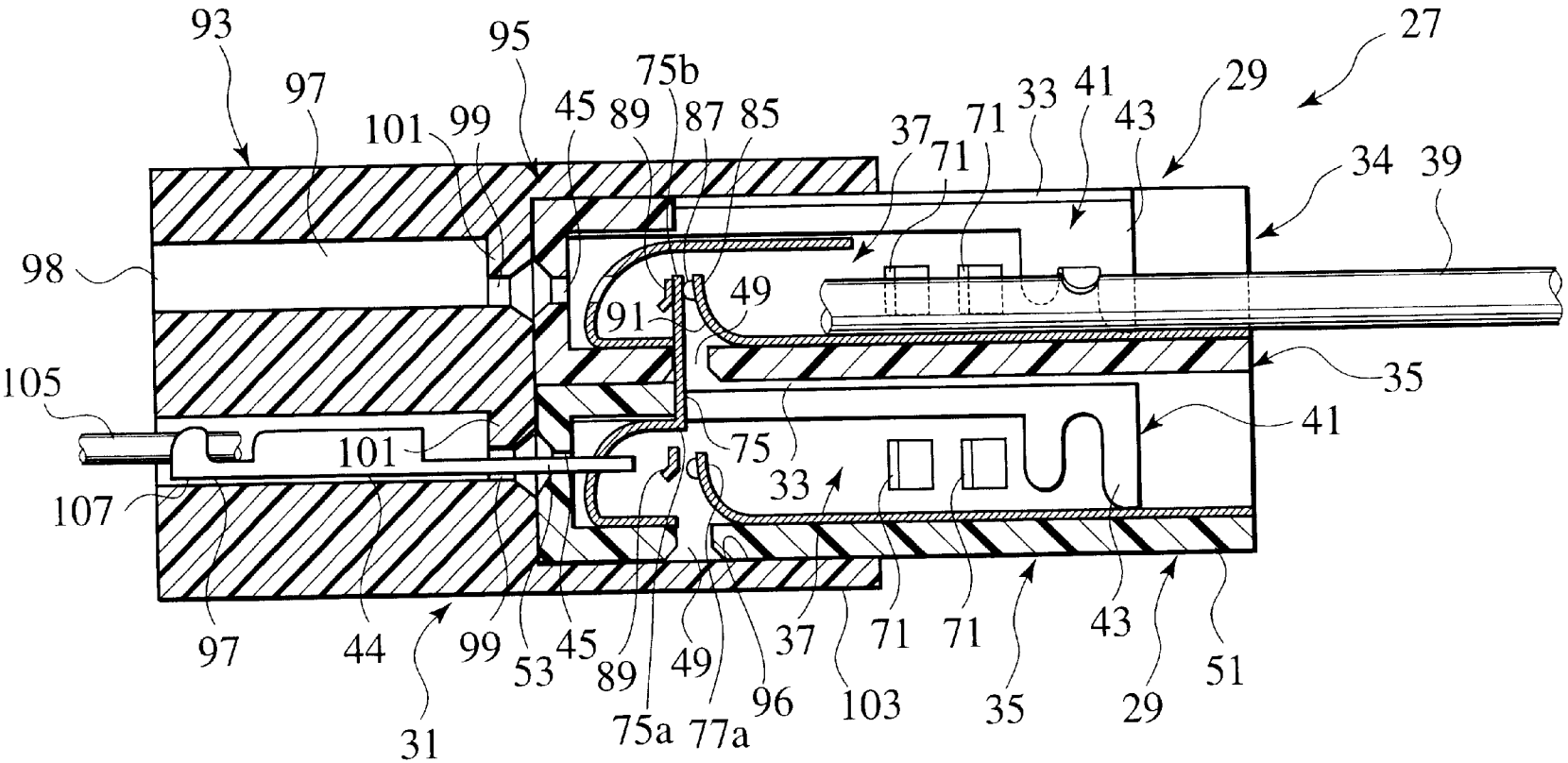
FIG. 1 is a sectional view showing an embodiment of a connector system according to the invention.

As shown in FIG. 1, connector system 27 includes housings 29 stacked in multiple steps; and a holder 31 holding housings 29 together. Housings 29 each include: housing body 35 in a box shape with an opening 33*a* on its upper face; and terminal unit 36 including connected terminals each located in housing body 35.

Housing bodies 35 each include partitions 43 separating a space into terminal accommodating channels 41; insertion holes 45 each provided at the inner end of the housing body 35 for mating with terminal 44 of holder 31 as will be described later; openings 34 each provided at the other end for wire 39 to extend from housing body 35; and insertion holes 49 each formed in the outer circumferential wall of housing body 35.

Terminal accommodating channels 41 are arranged in rows in housing body 35. The top of each channel 41 faces toward opening 33.

Partitions 43 of a rectangular sheet shape each project upward from the bottom wall 51 on the inner circumference of housing body 35, being integrally formed with arrangement at a predetermined pitch. Housing body 35 has insertion holes 45 for mating terminal 44, provided at the inner end thereof.

Insertion-holes 45 are formed to the outer circumferential wall of the inner end of the housing body 35, passing from the inner to the outer of the outer circumferential wall. The insertion-holes 45 correspond respectively to the channels 41. When external and internal connectors 29, 31 are matted with each other, tabs 53 of mating terminals 44 are inserted selectively in channels 41.

Housing body 35 with insertion holes 45 at its inner end has openings 34 in canals 41 at its other end, through each of which wire 39 extends from housing body 35 when, as described above, terminal 37 of terminal unit 36 accommodated in housing body 35, is assembled with wire 39. Housing body 35 has insertion holes 49 on bottom wall 51 as described above.

Insertion holes 49 each have a rectangular opening, which passes through the inner and outer circumferential faces of the bottom wall 51 of housing body 35.

Figure 2:
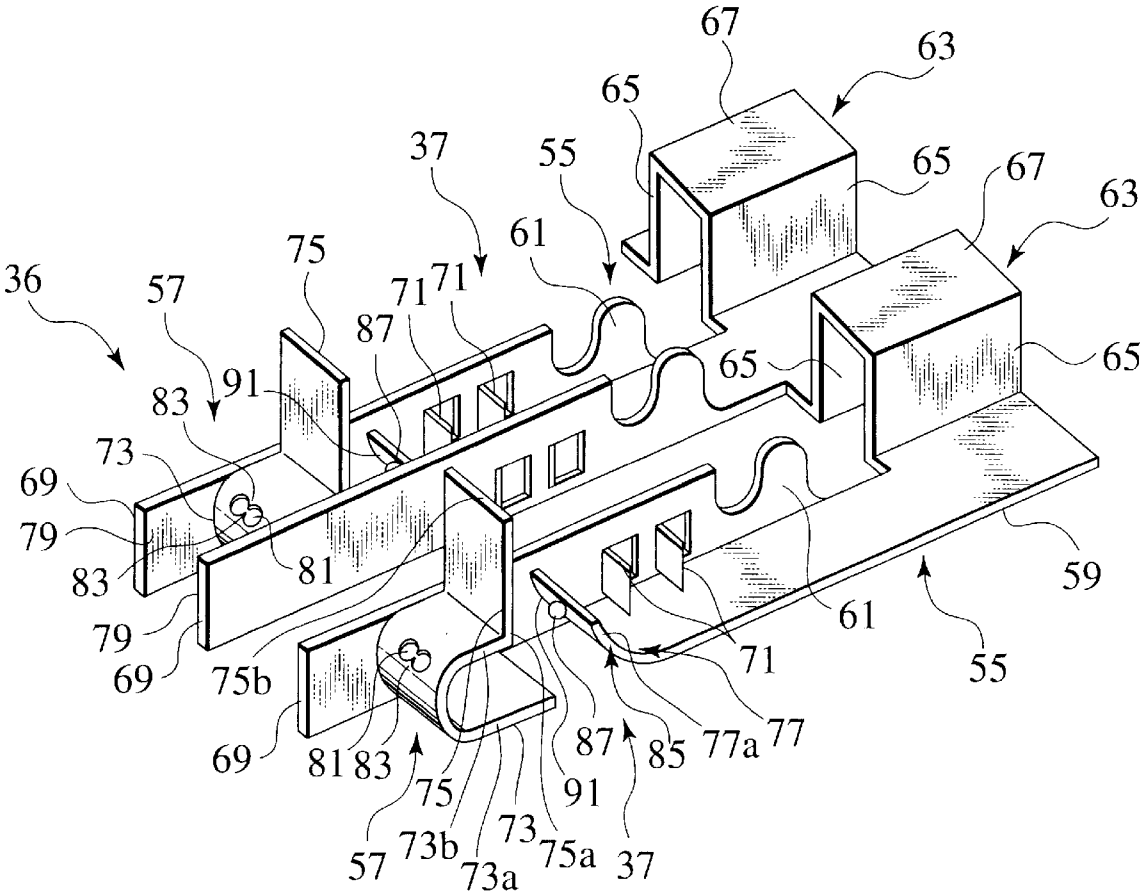
FIG. 2 is a perspective view of terminals of a connector system in FIG. 1.

To housing body 35, which has terminals 37 accommodated in canals 41 respectively, is assembled terminal unit 36 of terminals 37 selectively connected each other. Terminals 37 constituting terminal unit 36, as shown in FIGS. 1 and 2, each have base 55 formed at one end and contact part 57 formed at the other end. Base 55 has: bottom wall 59; wire holding part 61 formed to bottom wall 59; and connection part 63 formed to the side edges of bottom wall 59.

Bottom wall 59 is configured in a rectangular shape, with wire holding parts 61 formed integrally thereto. Wire holding parts 61 are each composed of a pair of sheet-shaped members, and are located in parallel at the side edges of bottom wall 59 respectively. Wire holding parts 61 are each bent to hold wire 39 in a state of connecting state when wire 39 is connected to terminal 37. To bottom wall 59 is formed connection part 63 for the connection between neighboring terminals 37.

Connection part 63 is configured as a sheet with a U-shaped cross-section, and is composed of a pair of side plates 65; and top plate 67. One of side plates 65 is formed integrally to the side end of bottom wall 59, while the other is formed integrally to the side end of bottom wall 59 of neighboring terminal 37. Side plates 65 each project upward from bottom wall 59, with top plate 67 formed integrally between their ends. Top plate 67 connects side plates 65 integrally each other. Such formed connection parts 63 each cross over partition 43 when terminals 37 are assembled to housing body 35. At the other end of each terminal 37 is formed contact part 57.

Contact parts 57 as a contact sheet each include side plates 69 formed integrally to bottom wall 59; insulation displacing blades 71 protruding from sides of side walls 69; curved plate 73 mounted between the sides of side walls 69; contact piece 75 formed integrally with curved plate 73; connection part 77 for the connection of contact piece 75 of another stacked housing 29.

Side plates 69 are each configured in a rectangular shape, being located at both the side edges of bottom wall 59 in parallel and opposite to each other. Side plates 69 each have insulation displacing blades 71 formed on the side thereof.

Insulation displacing blades 71 in a sheet shape are each formed by cutting and bending the respective side walls 69 inward to project inward from respective opposed sides 79. The ends of blades 71 are located to face each other. The dimensions between the ends are slightly smaller than the diameter of the core of wire 39. Such formed side walls 69 are each integrally formed with curved plate 73.

Curved plates 73 of a sheet shape are each curved from one end 73*a* to the other end 73*b*. One end 73*a* of curved plate 73 is located at the lower portion of a side plate 69, while the other end 73*b* is located directly above this. Curved plates 73 each have connection hole 81 provided thereto.

Connection holes 81 as a second contact part each pass through the inner side and the outer side of curved plate 73. Press-contact projections 83 with ends each directed to the center project from opposite edges of the opening. The dimension between the ends of projections 83 is substantially equal to or slightly smaller than the thickness of mating terminal 44 to be described later. Such connection holes 81 are each provided at a position corresponding to insertion hole 45 formed to housing body 35. The other end 73*b* of curved plate 73 has contact piece 75 formed integrally thereto. Connection holes 81 are each inclined to the connecting or insertion direction of the mating terminal 44 for the secure connection with the mating terminal 44.

Contact pieces 75 of a rectangular shape are each located in a longitudinal direction of the terminal, and are parallel with bottom wall 59 when in a normal position. One end 75*a* of the contact piece 75 as a fixed end is connected to curved plate 73. The other end 75*b* is a free end which is to be displaced angularly on the fixed end 75*b* from the normal position to a raised position with a substantially perpendicular direction relative to bottom wall 59. Contact piece 75 is displaced to a raised position via opening 33 of housing body 35, and is connected to connection part 77 of another housing 29 stacked above it when housings 29 are stacked in multiple steps.

Connection parts 77 are each located above insertion hole 49, being constituted with resilient press part 85 at the end of the bottom wall 59; protrusion 87 formed on resilient press part 85; and support part 89 located to face press part 85. Press part 85 is formed such that the end of bottom wall 59 is curved upward, being resilient. Convexly curved face 91 of press part 85 has protrusion 87 with a curved face, provided thereon. Protrusion 87 is located at the end 77*a* of curved part 77. At a position with a gap of dimensions substantially equal to or slightly smaller than the thickness of contact piece 75 from protrusion 87, support part 89, formed by bending side wall 69, is located facing protrusion 87.

Though necessarily only resilient press part 85 of connection parts 77 is provided with protrusion 87, support part 89 is also preferably provided with protrusion 87. Only support part 89 is preferably provided with protrusion 87. Such formed housings 29 are stacked, connected together and held with holder 31.

Holder 31, as shown in FIG. 1, includes housing body 93; hood 95 formed to housing body 93 for holding housings 29; and mating terminal 44 to be connected to terminal 37 of terminal unit 36 of housing 29 when stacked housings 29 are held. If holder 31 is regarded as the mating connector of stacked housings 29, housings 29 are mated and held together.

Housing body 93 includes terminal accommodation chambers 97 formed in rows inside thereof. Terminal accommodation chambers 97 are formed in multiple steps in correspondence to the positions of grooves 41, respectively. Chambers 97 each have an assembly opening 98 for the insertion of a mating terminal 44, provided at the end thereof, while a through-hole 99 is provided at the other end. Through-hole 99 passes through the inner side and the outer side of the outer circumferential wall 101 as the other end. Housing body 93 is provided with hood 95.

Hood 95 includes annular outer circumferential wall 103, being formed integrally to housing body 93. Hood 95 includes an insertion opening 96 for the insertion of housings 29 at the end thereof, with above-described through-holes 99 at the other end thereof. Within hood 95, tab 53 of mating terminal 44 projects through hole 99.

Mating terminal 44 includes base 107 provided at one end thereof for the connection with wire 105; and tab 53 provided at the other end for the connection to terminal 37. The rectangular-shape tab 53 in a rectangular shape passes through hole 99, projecting into hood 95, while mating terminal 44 is accommodated in chamber 97.

The thus formed connector system 27 is assembled with stacked housing 29 and is held by holder 31.

When assembling housings 29, the accommodation of terminal unit 36 in housing body 35 precipitates the connection of respective wires to respective terminals 37 of terminal unit 36. Assembled housings 29 are stacked in multiple steps.

When terminals 37 are assembled to above-described housing bodies 35, the terminals 37 are positioned between partitions 43 of channels 41, respectively. In this state, terminals 37 are inserted in channels 41 via their contact parts 57. Terminals 37 are inserted in an incomplete insertion position, so that they are in provisional accommodation state, without connection parts 63 being accommodated.

Figure 3A:
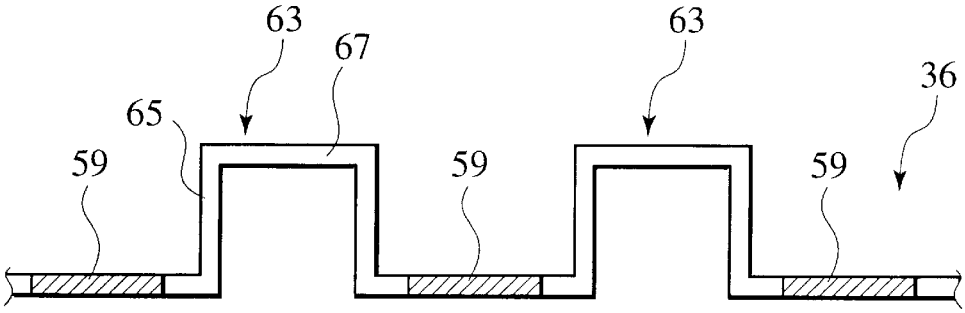
FIG. 3A is an elevation view showing connection parts to be cut off between terminals in FIG. 2.
Figure 3B:
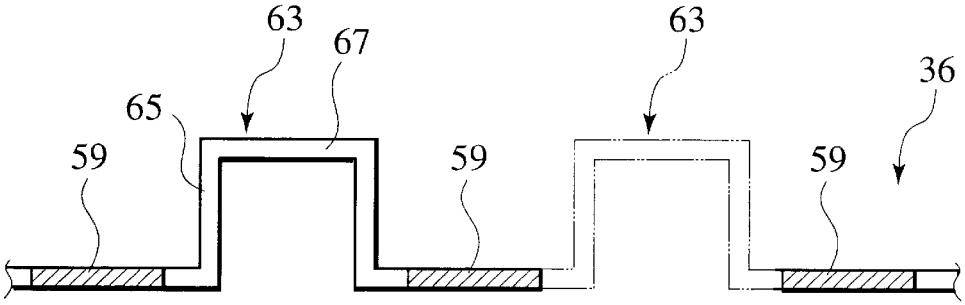
FIG. 3B is an elevation view showing the cut-off connection parts between terminals in FIG. 2.
Figure 4:
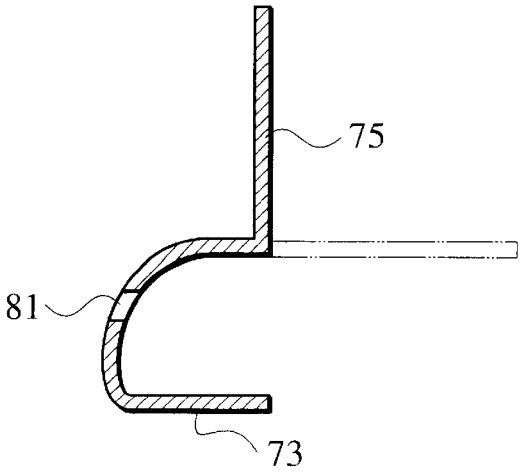
FIG. 4 is a sectional view of a contact sheet of a terminal in FIG. 2, the contact sheet being displaced in a raised position.

In connected terminals 37, as shown in FIGS. 3A and 3B, connection parts 63 provided at predetermined positions are selectively cut off for electrical break. Terminals 37, as shown in FIG. 4, are displaced from a normal position to a raised position in accordance with the design of the electrical circuit. In this state, terminals 37 are each inserted at regular insertion position in channel 41 to accommodate whole terminals 37 in channels 41.

Thereafter, wires 39 are assembled respectively to terminals 37. Wires 39 are each connected to terminal 37 through the opening of housing body 35. Wires 39 are each pressed to blades 71 for contact. In this state, the pressing of wires 39 causes press contacting between blades 71 provided on the opposite faces of side walls 69. This results in the connection of the ends of blades 71 with the cores, thus completing housing 29 with terminals 37 connected respectively to wires 39. When assembling wires 39 to terminals 37, only predetermined terminals 37 are to be connected to wires 39 in accordance with the circuit design.

When stacking assembled housings 29, the vertical overlapping of housings 29 with predetermined contact pieces 75 in a raised position causes contact piece 75 of the lower housing 29 to be inserted into insertion hole 49 of the upper housing 29 and to be connected to connection parts 77 of the respective terminals 37.

Contact pieces 75 each come into contact with protrusion 87 of press part 85, and, in this state, contact piece 75 is inserted into connection part 77. When the pressing of contact piece 75 to press part 85 causes the passing of protrusion 87 over contact piece 75, the pressing of protrusion 87 to the side of contact piece 75 causes the other side to contact support part 89, thus causing slidable contact protrusion 87 with the side of contact piece 75. In this state, when contact piece 75 is inserted at the regular insertion position of connection part 77, as a whole, connection part 77 holds contact piece 75 therebetween to connect between terminals 37. This improves the contact pressure of contact piece 75 and connection part 77. Thus, stacked housings 29 are constituted with a two dimensional circuit with a connecting direction of terminals 37 of terminal unit 36 and a stacked direction of housings 29.

When holder 31 is assembled, wire 105 is connected to mating terminal 44, and mating terminal 44 is accommodated selectively in chambers 97.

Wire 105 is connected to mating terminal 44 by crimping. Mating terminal 44 mounted to wire 105 is inserted into predetermined chamber 97 of housing body 93 at a regular insertion position, thus completing holder 31 with respective terminals connected to respective wires.

Holder 31 holds housings 29. Housings 29 are in conformance with hood 95 of holder 31. In this state, the insertion of housings 29 into hood 95 causes the mating of housings 29 with holder 31. Relative to stacked housings 29, tab 53 of mating terminal 44 is inserted inside housing body 35 from insertion hole 45. When housings 29 are inserted in hood 95 to a regular insertion position, holder 31 holds stacked housings 29, and tab 53 of mating terminal 44 provided to predetermined chamber 97 is connected selectively to connection hole 81 of terminal 37. Between projections 83 of hole 81, tab 53 is pressed and contacted, which causes the ends of projections 83 to be slidably contacted with both sides of tab 53. In this state, the passing of tab 53 through hole 81 results in the connection of terminal 37 and mating terminal 44.

Figure 5:
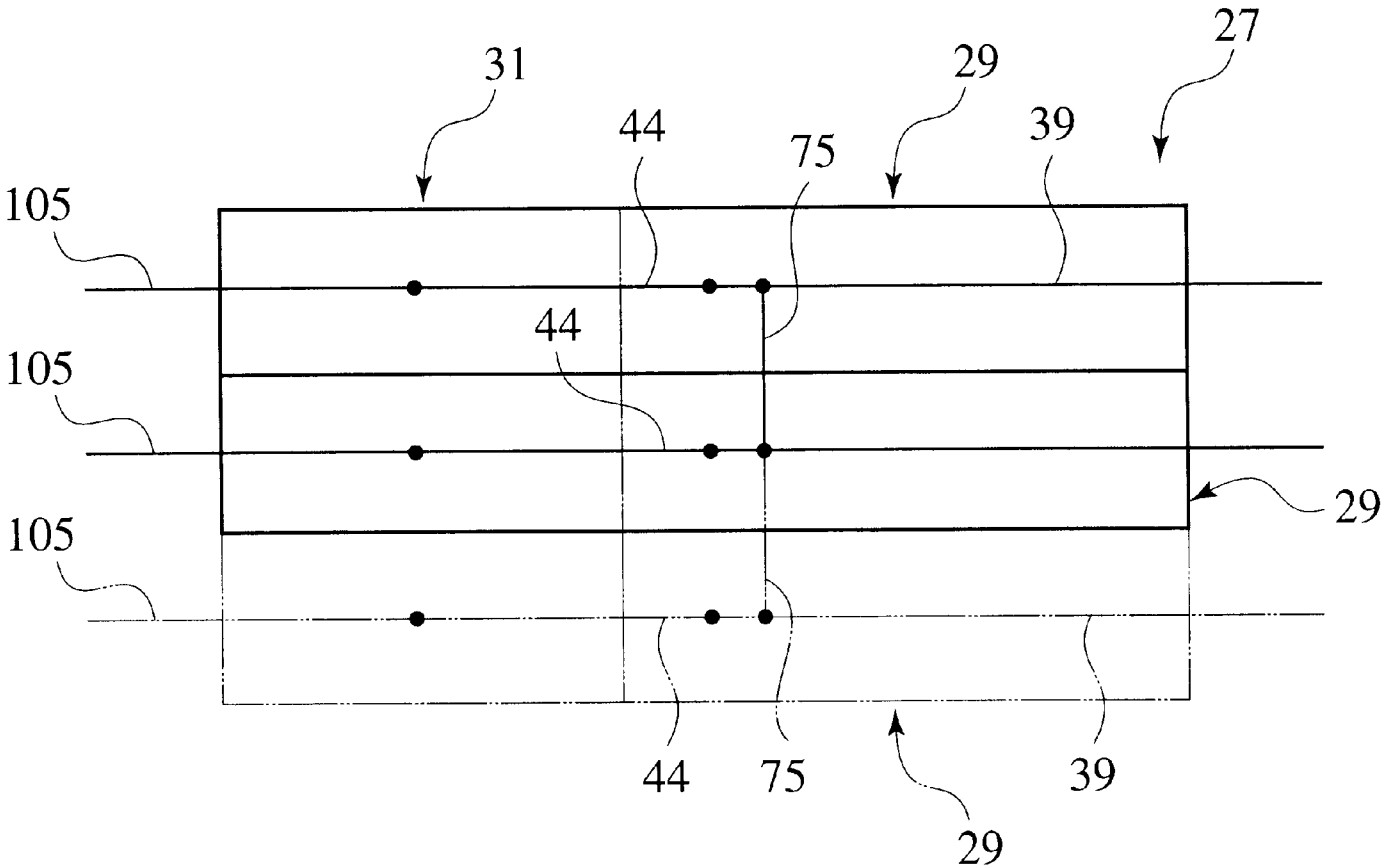
FIG. 5 is a schematic view showing the connecting between terminal units and between the terminal units and mating terminals in a connector system.

Thus, in connector system 27, as shown in FIGS. 1 and 5, the formation of the circuit in the stacking direction of the housings 29, the connecting direction of terminal unit 36 and terminal 37, and the mating direction of stacked housings 29 and holder 31, together constitute a three dimensional circuit.

In the aforementioned connector system 27 of the embodiment, housings 29, which accommodate terminals 37 respectively connected to wires 39 in housing bodies 35, are stacked in multiple steps. With housings 29 stacked, mating terminal 44 in connection with wire 105 is connected to holder 31 accommodated in housing body 93 for assembly to constitute a three dimensional circuit, thus without over-enlargement a complicated circuit can be constituted easily.

In connector system 27, the accommodation of connected terminals 37 in housing bodies 35, the connection of respective wires 39 to respective terminals 37 for the assembly of housings 29, and the stacking of assembled housings 29 in multiple steps increases the stack number of housings 29, thus allowing complicated circuit to be easily constituted.

Terminals 37 of housings 29 are connected before connection parts 63 are cut off in accordance with the design of the electrical circuit, and contact pieces 75, which are in a raised position, connect between stacked housings 29 in accordance with a design of an electrical circuit. Therefore, a plurality of kinds of terminals and housings is, as is conventionally required in accordance with the design of an electrical circuit, not necessary, thus allowing terminals 37 and housing bodies 35 to be multi-purpose and to reduce production costs.

When the stacking of housings 29 precipitates the connection of contact piece 75 with connection part 77, one side of contact piece 75 is slidably contacted with protrusion 89 of press part 85, while the other side slidably contacts support part 89.

When contact piece 75 and connection part 77 are connected, the reduction of the contact area of contact piece 75 and press part 85 allows the insertion force of contact piece 75 into connection part 77 to be reduced. Thus, this allows the stacking of housings 29 and the assembly of connector system 27 to be facilitated.

When holder 31 holds stacked housings 29 between projections 83 of hole 81, tab 53 is pressed for fitting, which causes the ends of projections 83 to be slidably contacted with both the sides of tab 53. Thus, this allows the reduction of the insertion force of tab 53 into hole 81 and the connection of housings 29 to holder 31 facilitates the assembly operation of connector system 27.

In connector system 27, by stacking housings 29, these housings 29 are mated with a holder 31 to constitute a circuit, thus improving the arrangement density of the circuit for small-sizing.

According to the invention, with the assembly of the terminal unit 36 to the first housing 29, respective first terminals 37 are accommodated in respective channels 41. With the first housings 29 being stacked, terminal units 36 are connected selectively therebetween. When the second housing or holder 31 holds the stacked first housings 29 together, a terminal unit 37 and the second terminal 44 of the second housing 31 are selectively connected to constitute a three dimensional circuit. Thus, the connector system facilitates the constitution of a complicated circuit without over-enlargement.

The connector assembly allows connected first terminals 37 to be cut off therebetween and stacked first housings 29 to be connected selectively and together therebetween, corresponding to the design of the electrical circuit. This improves the degree of freedom relative to the electrical circuit design and the ability of multi-purpose, thus reducing production cost.

The first contact parts 75 of the first terminals 37 of the first housing 29 are selectively displaced in a raised position. In this state, the stacking of the first housings 29 in multiple-steps causes the connecting of a first contact part 75 with a neighboring connection part 77 of a neighboring first housing 29. The first terminals 37 of stacked first housings 29 and the second terminal 44 are connected selectively, and this sets a desired circuit easily.

When the first contact part 75 and the neighboring connection part 77 are connected, the insertion of the raised first contact part 77 between the press part 85 and the support part 89 causes the pressing of the first contact part 75 to the support part 89 by a resilient force. This allows the protrusion 87, formed to one of the press part 85 and the support part 89, to be slidably contacted with the first contact part 75. Thus, the first contact part 75 and the connection part 77 reduce in contact area for the improvement of the insertion-ability, thus facilitating the stacking operation of the first housings 29.

By pressing the second terminal 44 by the projection 83, projection 83 slidably contacts the second terminal 44. The second terminal 44 passes through the contact hole 81 for the connection with the first terminal 37 and the second terminal 44. Thus, the contact hole 81 and the second terminal 44 reduce in contact area for the press-contact ability, thus facilitating the assembly operation.

The entire content of Japanese Patent Application of P2000-222978(filed on Jul. 24, 2000) is incorporated herein by reference.

While preferred embodiments of the present invention have been described using specific terms, such description is for illustrative purposes, and it is to be understood that changes and variations may be made without departing from the spirit or scope of the following claims.

What is claimed is:

1. A connector system comprising:

a first connector comprising:

a set of stacked first housings, first housings each comprising side walls defining channels therebetween; and a set of terminal units, terminal units each comprising a set of first terminals, respective first terminals being located in respective channels, one of first terminals configured to pass through a neighboring first housing with a neighboring first terminal and to connect,the neighboring first terminal; and a second connector mated with the first connector, the second connector comprising:

a second housing holding the set of first housings; and a second terminal housed in the second housing, the second terminal configured to pass through the second housing and one of the first housings and to connect one of first terminals.

2. A connector system according to claim 1, wherein first terminals each comprising:

a base sheet;

a contact sheet extending from the base sheet and having an end, the contact sheet being turned back and facing the base sheet, the contact sheet comprising a first contact part raised at the end for contacting the neighboring first terminal in the neighboring first housing.

3. A connector system according to claim 2, wherein the contact sheet comprises a second contact part defining a contact hole for inserting the second terminal and contacting the second contact part with the second terminal.

4. A connector system according to claim 2, wherein the contact hole is inclined to an insertion direction of the second terminal.

5. A connector system according to claim 3, wherein the second contact part comprising a projection projecting inside of the contact hole, the projection being configured to press the second terminal for contact, with the second terminal being inserted into the contact hole.

6. A connector system according to claim 2, wherein the contact sheet comprises: a connection part configured to connect the neighboring first contact part in the neighboring first housing, and the connection part comprises: a press part raised from the contact sheet and defining an opening for inserting the neighboring first contact part, the press part configured to press a side of the neighboring first contact part; and a support part facing the press part for supporting another side of the neighboring first contact part.

7. A connector system according to claim 6, wherein the connection part comprises a protrusion on one of the press part and the support part.

8. A connector system according to claim 1, wherein the terminal units each comprise a connection sheet crossing over a side wall and connecting between neighboring first terminals.

9. A connector system according to claim 1, wherein first terminals each comprise a blade for displacing an insulation of an insulated wire to be contacted.

* * * * *